US012037886B1

(12) United States Patent
Al-Rubaii

(10) Patent No.: US 12,037,886 B1
(45) Date of Patent: Jul. 16, 2024

(54) EVALUATING CARBON DIOXIDE EMISSION DURING DRILLING OPERATIONS

(71) Applicant: Saudi Arabian Oil Company, Dhahran (SA)

(72) Inventor: Mohammed Murif Hassan Al-Rubaii, Dammam (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 18/112,268

(22) Filed: Feb. 21, 2023

Related U.S. Application Data

(60) Provisional application No. 63/480,657, filed on Jan. 19, 2023.

(51) Int. Cl.
*E21B 44/00* (2006.01)
*E21B 21/08* (2006.01)

(52) U.S. Cl.
CPC ..... *E21B 44/00* (2013.01); *E21B 21/08* (2013.01)

(58) Field of Classification Search
CPC ..... E21B 44/00; E21B 21/08
See application file for complete search history.

(56) References Cited

U.S. PATENT DOCUMENTS 5,216,917 A 6/1993 Detournay
7,243,735 B2 7/2007 Koederitz et al.
9,181,792 B2 11/2015 Pena
10,221,671 B1 3/2019 Zhang
10,781,682 B2 9/2020 Al-Rubaii et al.
2010/0252325 A1 10/2010 Porche
2011/0088892 A1* 4/2011 Freyer ..... E21B 33/1216 166/134
2022/0374913 A1* 11/2022 Allen ..... E21B 7/00

OTHER PUBLICATIONS

U.S. Appl. No. 17/579,103, Publication Date Jul. 20, 2023, Al-Rubaii et al.
Armenta, "Identifying Inefficient Drilling Conditions Using Drilling-Specific Energy" presented at the Annual Technical Conference and Exhibition, Denver, Colorado, Sep. 21-24, 2008, 16 pages.
Dupriest et al., "Maximizing Drill Rates with Real-Time Surveillance of Mechanical Specific Energy," presented at the SPE/IADC Drilling Conference, Amsterdam, Netherlands, Feb. 23-25, 2005, 10 pages.

* cited by examiner

*Primary Examiner* — Dany E Akakpo
(74) *Attorney, Agent, or Firm* — Fish & Richardson P.C.

(57) ABSTRACT

Systems and methods for evaluating carbon dioxide emissions during drilling operations include measuring a plurality of mechanical drilling parameters and a plurality of drilling fluid parameters; determining a hole cleaning index that indicates an effectiveness of removing cuttings from a borehole, the hole cleaning index comprises a cutting concentration in an annulus and a carrying capacity index that specifies the carrying capacity of the drilling fluid, determining being based on the measured parameters; evaluating hydraulic pressures in the borehole and in a drill bit based on the measured parameters; calculating a drilling specific energy based on the hole cleaning index and the evaluated hydraulic pressures; calculating carbon dioxide emissions of the drilling operation based on the drilling specific energy; and determining drilling parameters based on minimizing the drilling specific energy and calculated carbon dioxide emissions.

20 Claims, 12 Drawing Sheets

EVALUATING CARBON DIOXIDE EMISSION DURING DRILLING OPERATIONS

CROSS REFERENCE TO RELATED APPLICATIONS

This application claims the benefit of U.S. Provisional Application Ser. No. 63/480,657, filed on Jan. 19, 2023, the entire contents of which are incorporated herein by reference in their entirety.

TECHNICAL FIELD

This disclosure relates to evaluating carbon dioxide emission during drilling operations.

BACKGROUND

The efficiency of drilling operations, such as for drilling an oil well, can be affected by many factors. Some of the factors are associated with the performance of rig equipment. Other factors are associated with the types of geology that are encountered by the drill bit. Factors that affect the drilling operations include, for example, fluid densities, drilling rates, and hole cleaning efficiency. The efficiency of drilling operations can affect the amount of carbon dioxide and other toxic gases emitted into the environment.

SUMMARY

This specification describes systems and methods for monitoring, evaluating and reducing carbon dioxide emissions during well drilling operations. A data processing system calculates a drilling specific energy that accounts for mechanical drilling parameters, drilling fluid rheological parameters and hole cleaning efficiency. The data processing system optimizes drilling parameters to reduce the drilling specific energy and thereby reduce the carbon dioxide emissions during the drilling operations. In some implementations this occurs in real-time.

The processes and systems enable one or more of the following technical advantages. Optimization of the drilling parameters through drilling specific energy and carbon dioxide emissions enables immediate intervention when the drilling efficiency is not optimal based on the drilling energy. Optimizing drilling parameters can result in reducing the drilled cost per foot, fuel consumption, $CO_2$ and other related toxic gas emissions and improve overall rig performance. Applications of these systems and methods can also help mitigate stuck pipe incidents resulting from poor borehole cleaning.

One or more of these advantages are enabled by one or more of the following embodiments.

In one aspect, a method for evaluating carbon dioxide emissions during drilling operations includes measuring a plurality of mechanical drilling parameters and a plurality of drilling fluid parameters; determining a hole cleaning index that indicates an effectiveness of removing cuttings from a borehole, the hole cleaning index includes a cutting concentration in an annulus and a carrying capacity index that specifies the carrying capacity of the drilling fluid, determining being based on the measured parameters; evaluating hydraulic pressures in the borehole and in a drill bit based on the measured parameters; calculating a drilling specific energy based on the hole cleaning index and the evaluated hydraulic pressures; calculating carbon dioxide emissions of the drilling operation based on the drilling specific energy; and determining drilling parameters based on minimizing the drilling specific energy and calculated carbon dioxide emissions.

In one aspect, one or more non-transitory machine-readable storage devices storing instructions for evaluating carbon dioxide emissions of drilling operations, the instructions being executable by one or more processing devices to cause performance of operations including accessing, from a data store, a plurality of mechanical drilling parameters and a plurality of drilling fluid parameters; determining a hole cleaning index that indicates an effectiveness of removing cuttings from a borehole, the hole cleaning index includes a cutting concentration in an annulus and a carrying capacity index that specifies the carrying capacity of the drilling fluid, determining being based on the measured parameters; evaluating hydraulic pressures in the borehole and in a drill bit based on the measured parameters; calculating a drilling specific energy based on the hole cleaning index and the evaluated hydraulic pressures; calculating carbon dioxide emissions of the drilling operation based on the drilling specific energy; and determining drilling parameters based on minimizing the drilling specific energy and calculated carbon dioxide emissions.

In one aspect, a system for evaluating carbon dioxide emissions during drilling operations including at least one processor, and a memory storing instructions that, when executed by the at least one processor, cause the at least one processor to perform operations including measuring a plurality of mechanical drilling parameters and a plurality of drilling fluid parameters; determining a hole cleaning index that indicates an effectiveness of removing cuttings from a borehole, the hole cleaning index includes a cutting concentration in an annulus and a carrying capacity index that specifies the carrying capacity of the drilling fluid, determining being based on the measured parameters; evaluating hydraulic pressures in the borehole and in a drill bit based on the measured parameters; calculating a drilling specific energy based on the hole cleaning index and the evaluated hydraulic pressures; calculating carbon dioxide emissions of the drilling operation based on the drilling specific energy; and determining drilling parameters based on minimizing the drilling specific energy and calculated carbon dioxide emissions.

Embodiments of these systems and methods can include one or more of the following features.

In some embodiments, these aspects further include using the determined drilling parameters during drilling operations.

In some embodiments, the determining drilling parameters occurs in real time.

In some embodiments, these aspects further include updating the drilling specific energy by evaluating weight on bit, revolutions per minute, standpipe pressure, torque and flow rate.

In some embodiments, these aspects further include comparing a measured carbon dioxide emissions with the calculated carbon dioxide emissions.

In some embodiments, the carrying capacity index includes at least one of rheological, chemical, or physical properties of the drilling fluid.

In some embodiments, evaluating the hydraulics comprises a hydraulic jet impact force of a bit.

In some embodiments, a maximum safe rate of penetration is a constraint of the optimization.

In some embodiments, wherein the cuttings concentration in annulus is less than 0.05.

In some embodiments, these aspects further include displaying a real-time carbon dioxide release curve.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

This specification describes an approach for monitoring, evaluating and reducing carbon dioxide emissions during well drilling operations. The approach includes calculating a drilling specific energy that accounts for mechanical drilling parameters, drilling fluid rheological parameters and hole cleaning efficiency. The drilling parameters can be optimized to reduce the drilling specific energy and thereby reduce the carbon dioxide emissions during the drilling operations. In some implementations this can occur in real-time.

Figure 1:
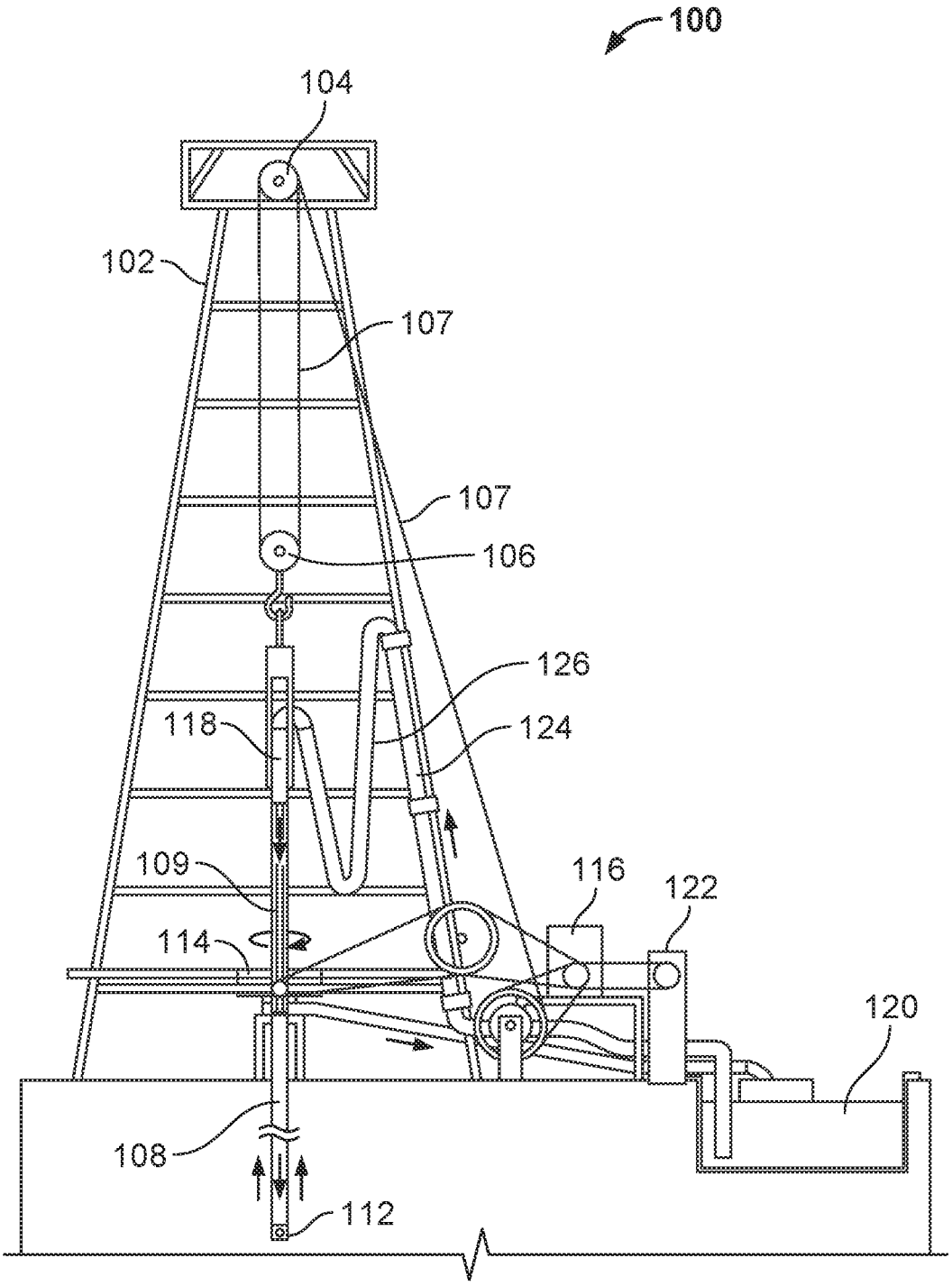
FIG. 1 is an illustration of an example well drilling rig.

FIG. 1 shows an illustration of an example well drilling rig 100. A derrick 102 provides a structure that supports the drilling equipment. A crown block 104 mounted at the top of the derrick 102, a traveling block 106, and a drill line 107 connected between them move the drill string 108 vertically. The drill string 108 includes a plurality of sections of drill pipe 110, a kelly bar 109, and a drill bit 112 or other bottom hole assembly. The kelly bar 109 is a square section of pipe that interfaces with a rotary table 114 to transfer torque from a motor or engine 116 to the drill string 108. A swivel 118 is connected between the top of the drill string 108 and the traveling block 106. The swivel 118 allows the drill string 108 to turn without turning the traveling block 106.

A drilling fluid or mud is used to remove cuttings from the well during drilling. A mud tank 120 holds the mud. A mud pump 122 pumps the mud from the mud tank 120 to the swivel 118 via a rigid standpipe 124 and a flexible hose 126. The mud is pumped through the center of the drill string 108 to the bottom of the hole through the drill bit 112. The mud returns to the surface carrying the cuttings through the annulus formed between the wall of the well and the outside of the drill string 108. The mud returns to the mud tank 120 via a flow line 128 where the cuttings are filtered, and the mud recirculates through the system.

As the drill string 108 rotates, the drill bit 112 engages with and cuts the bottom of the hole penetrating a subsurface formation. The rate at which the drill bit penetrates the formation is called the rate of penetration (ROP). The weight on the drill bit (WOB) is controlled by the amount of tension applied to the drill line 107 and can affect the ROP.

The motor or engine 116 that turns the drill bit and raises and lowers the drill string, the mud pump 122 and other equipment located on or near the drilling rig such as generators, burn fuel and emit carbon dioxide, $CO_2$. The amount of $CO_2$ emitted can be proportional to the fuel consumed by the drilling rig. Fuel consumption and $CO_2$ emissions can be reduced by optimizing various drilling parameters.

Figure 2:
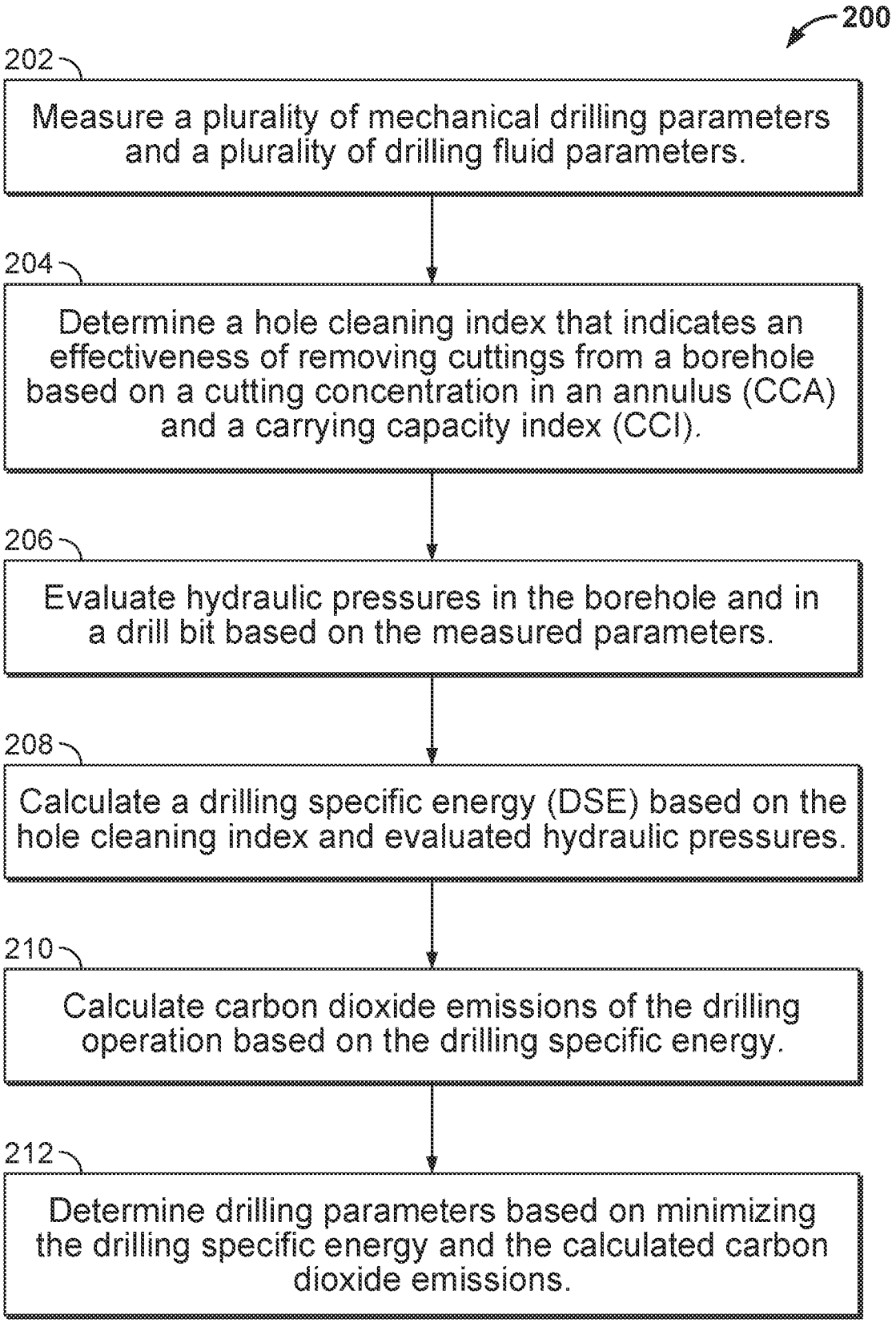
FIG. 2 is a flow chart of an example method for optimizing drilling parameters to reduce $CO_2$ emissions.

FIG. 2 is a flow chart of an example method 200 for optimizing drilling parameters to reduce $CO_2$ emissions. A data processing system acquires measurements of parameters of the drilling operation (step 202) for example by using sensors on the drilling rig and downhole. Parameters can include mechanical drilling parameters such as WOB, ROP, open hole diameter (OH), drill string rotation rate (RPM), outer drill pipe diameter (OD), torque applied to the drill string (TORQ), hole angle (HA), depth after last casing point (Dx), and targeted casing point (Cp). Measured parameters can also include drilling fluid parameters and rheology such as pumping rate (GPM), plastic viscosity (PV), yield point (YP), mud weight (MW), initial gel strength ($GS_i$), final gel strength (GSf), viscosity reading at 6 rotations per minute (6 RPM), viscosity reading at 3 rotations per minute (3 RPM), and low shear yield point (LSYP). In some implementations, the data processing system acquires measurements of some or all of these parameters are in real time. The data processing system can also acquire measurements of $CO_2$ emissions and fuel consumption.

Based on the measured parameters, the data processing system determines a hole cleaning index (X) that indicates an effectiveness of removing cuttings from a borehole. The hole cleaning index is based on a cutting concentration in annulus (CCA) and a developed carrying capacity index (CCI) (step 204).

$$X = \frac{CCI + CCA}{CCI - CCI \cdot CCA}. \tag{1}$$

The cuttings concentration in annulus is a dimensionless quantity, $$CCA = 0.0014\frac{ROP \cdot OH^2}{GPM}. \tag{2}$$

In some implementations, the CCA can be less than 0.05. The CCI is a dimensionless quantity that specifies a cuttings carrying capacity of the drilling fluid. The CCI is given by, $$CCI = \frac{EMW \cdot K \cdot V_{ann-c}}{5871}, \tag{3}$$

where EMW is an effective mud weight in pounds per cubic foot (PCF) or pounds per gallon (PPG), K is a flow consistency index in centipoise (cP), and $V_{ann-c}$ is a corrected average annular velocity in feet per minute (ft/min) or feet per second (ft/sec).

$$EMW=MW\cdot CCA+MW, \tag{4}$$

where MW is the mud weight in PCF or PPG.

$$K=\frac{PV+YP+LSYP}{511^n}, \tag{5}$$

where n is a flow behavior index, $$n=3.32\log\left(\frac{2PV+YP+\frac{ES}{400}+\frac{GS_f}{GS_i}+\frac{PH}{9}}{PV+YP+LSYP+\frac{ES}{400}+\frac{GS_f}{GS_i}+\frac{PH}{9}}\right), \tag{6}$$

where PH is the unitless power of hydrogen of the drilling mud and ES is the electrical stability of the drilling mud in volts (V).

$$LSYP=2\cdot 3RPM-6RPM, \tag{7}$$

where 3 RPM and 6 RPM are the viscosities at 3 revolutions per minute and 6 revolutions per minute, respectively.

The corrected average annular velocity, $V_{ann-c}$, incorporates a cutting rise velocity ($V_{cr}$) in ft/min, an average annular velocity ($V_{ann}$) in ft/min, a cuttings slip velocity ($V_{cs}$) in ft/min, a critical cuttings velocity ($V_{cc}$), and the hole angle (HA), $$V_{ann-c}=\frac{(V_{ann}+V_{cr}-V_{cs})}{4}\cos(HA)+\frac{(V_{ann}-V_{cr}-V_{cs})}{4}\sin(HA). \tag{8}$$

$$V_{cr}=\frac{60}{\left(1-\left(\frac{OD}{OH}\right)^2\right)\left(0.6+\frac{18.2}{ROP}\right)}, \tag{9}$$

where OD is the outer diameter of the drill pipe in inches, OH is the open hole diameter or bit size in inches, and ROP is the rate of penetration in feet per hour (ft/hr).

$$V_{ann}=\frac{24.5GPM}{OH^2-OD^2}, \tag{10}$$

where GPM is the flow rate or pumping rate of the drilling mud in gallons per minute (gpm).

$$V_{cs}=\frac{175\cdot 0.2\left(\frac{ROP}{\mathrm{RPM}}\right)\left(21.5-\frac{\mathrm{MW}}{7.5}\right)^{0.667}}{\left(\frac{\mathrm{MW}}{7.5}\right)^{0.333}\left(\frac{\mathrm{MW}/7.5}{64}(MF-28)\right)^{0.333}}, \tag{11}$$

where MF is the march funnel viscosity of the drilling mud in pounds per hundred feet (lbs/100 ft) and $$V_{cc}=\frac{ROP(OH^2)}{183}. \tag{12}$$

The data processing system evaluates hydraulic parameters of the pumping system and jetting at the drill bit (step 206). The hydraulic pressure of mud pump influences (HSImp) in pounds per square inch (psi) is characterized by $$HSImp=0.00074SPP\frac{GPM}{OH^2}, \tag{13}$$

where SPP is the standpipe pressure in psi. The hydraulic pressure of the bit influences (HSIb) in psi is $$HSIb=0.00074dpb\frac{GPM}{OH^2}, \tag{14}$$

where dpb is the drill bit pressure loss in psi, $$dpb=\frac{EMW\cdot GPM^2}{81000TFA^2}. \tag{15}$$

TFA is the total flow area of the bit $$TFA=\frac{3.14}{4}n_1\left(\frac{d_1}{32}\right)^2+\frac{3.14}{4}n_2\left(\frac{d_2}{32}\right)^2+\frac{3.14}{4}n_3\left(\frac{d_3}{32}\right)^2+\ldots+\frac{3.14}{4}n_i\left(\frac{d_i}{32}\right)^2, \tag{16}$$

where $n_i$ and $d_i$ are the number of bit nozzles and the diameter of the bit nozzles for the ith bit nozzle. The jet impact force of the bit (JIF) in pounds is given by $$JIF=0.00633GPM(EMW\cdot dpb)^{0.5}. \tag{17}$$

The jet impact force of the bit per square inch (JIFSI) is given by $$JIFSI=\frac{JIF}{OH^2}, \tag{18}$$

and the hydraulics of the jet impact force per square inch (HIIFSI) is given by $$HJIFSI=\frac{JIFSI\cdot GPM}{1714}. \tag{19}$$

The data processing system determines a drilling specific energy (DSE) in psi based on the evaluated hydraulics and the hole cleaning index (step 208), $$DSE=\frac{1.27(WOB-JIF)}{OH^2}+\frac{480RPM\cdot TORQ}{OH^2\cdot ROP}-\frac{3{,}189{,}335(HSIb\cdot(HSImp+HJIFSI))^X}{OH^2\cdot ROP}. \tag{20}$$

In some implementations, the data processing system compares the calculated DSE with a mechanical specific energy (MSE) in psi, where $$MSE=\left(\frac{480\ TORQ\cdot RPM}{OH^2\cdot ROP}+1.273\frac{WOB}{OH^2}\right)\cdot\text{(Teal 1965)} \tag{21}$$

The data processing system calculates an efficiency factor E based on the DSE and MSE, $$E = \left|\frac{MSE - DSE}{MSE}\right|. \tag{22}$$

The data processing system calculates an average efficiency factor $E_{avg}$ based on the average values of MSE and DSE, $$E_{avg} = \left|\frac{MSE_{avg} - DSE_{avg}}{MSE_{avg}}\right|. \tag{23}$$

The data processing system calculates the average values of MSE and DSE along the depth of the well. Further, the data processing system can normalize the MSE and DSE along the depth of the well by the average value generating sets of average normalized MSE and DSE values.

The data processing system calculates daily saved fuel y in bbl as $$y=Z-Z(E), \tag{24}$$

where Z is the daily consumed fuel in bbl.

The data processing system calculates carbon dioxide emissions of the drilling operation using the drilling specific energy (step 210).

$$CO_2\left(\frac{\text{kg}}{\text{ft}}\right) \text{ by } MSE = \frac{420Z}{(CP-(Dx-92))}, \tag{25}$$

$$Co2\left(\frac{\text{kg}}{\text{ft}}\right) \text{ by } DSE = \frac{420y}{(CP-(Dx-92))}, \tag{26}$$

and $$CO_2\left(\frac{\text{kg}}{\text{ft}}\right) \text{ by Average normalized } DSE = \frac{420(Z-Z(E_{avg}))}{(CP-(Dx-92))}, \tag{27}$$

where CP is the target casing point in feet, Dx is the last casing point in feet or drilled formation depth in feet.

The data processing system determines optimal drilling parameters by minimizing the DSE and calculated $CO_2$ emissions to reduce the carbon dioxide emissions of the drilling operation (step 212). In some implementations, a maximum safe ROP can be used to constrain the optimization, $$\text{Max. Safe Limit } ROP = \frac{35GPM}{OH^2}. \tag{28}$$

In some implementations, the CCA is constrained to be equal to 0.05, the CCI is constrained to be greater than or equal to 1.5 and the HSIb and HSImp are each greater than or equal to about 3 to 5.

In an example implementation, the data processing system minimizes calculated $CO_2$ emissions using ROP, WOB, RPM, GPM, n, K, TFA, JIF, and $V_{ann-c}$ as free parameters when calculating DSE. By altering the values of the free parameters, the data processing system changes the value of DSE, which is incorporated in the calculated $CO_2$ value through the efficiency factor, E. In some implementations, the data processing system uses a minimization algorithm such as gradient descent or particle swarm optimization to perform the minimization.

In some implementations, the data processing system generates commands to control the drilling parameters during the drilling operation based on the optimization of DSE and carbon dioxide emissions.

In some implementations, the data processing system iteratively performs method 200 in real time to make immediate adjustments to drilling operations. In some implementations, the data processing systems displays a real-time carbon dioxide release curve. For example, the data processing system displays a real-time carbon dioxide release curve on a computer display near the controls of the drilling operation so that an operator can monitor the real-time carbon dioxide emissions.

In some implementations, the data processing system applies method 200 to different hole section types. For example, the method 200 can be applied to a vertical well, a deviated well, a horizontal well, or a lateral well. In some implementations, the data processing system incorporates a bottom hole assembly design while executing the method 200.

In some implementations, the drilling fluid is water based or oil based. In some implementations, the drilling fluid parameters include an apparent or effective viscosity. In some implementations, the real-time mud weight is used.

Figure 3:
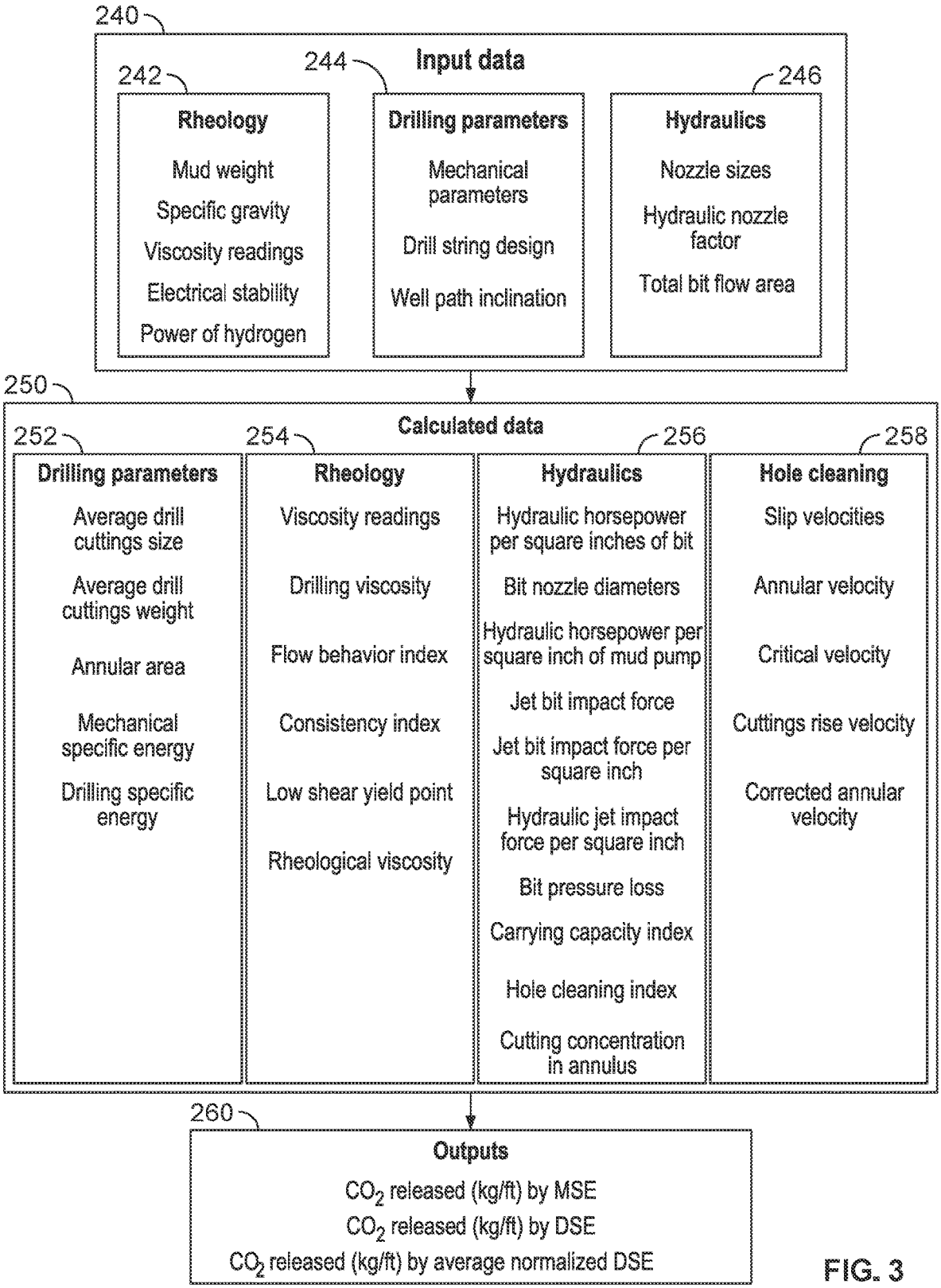
FIG. 3 shows a summary of inputs, calculated values, and outputs from an example method for optimizing drilling parameters to reduce $CO_2$ emissions.

FIG. 3 shows a summarization of example input data 240 to the data processing system, values calculated by the data processing system 250, and output data 260 from the data processing system for monitoring and reducing carbon dioxide emissions in an implementation of the method 200. The input data includes rheological properties 242 of the drilling fluid including physical and chemical properties of the drilling fluid. For example, mud weight, specific gravity, viscosity readings, electrical stability or pH reading. The inputs also include drilling parameters 244 such as mechanical parameters, drill string design and well path inclination. The hydraulics 246 of the system can also be input data. For example, nozzle sizes, hydraulic nozzle factor and total bit flow area.

The calculated values 250 include calculated drilling parameters 252 such as average cutting size and weight, annular area, MSE, and DSE. Rheological values 254 can also be calculated, for example, viscosity readings, flow behavior index, flow consistency index, and low shear yield point. Hydraulic parameters 256 are also calculated such as JIF, JIFSI, and HJIFSI. Hole cleaning velocities 258 and other hole cleaning parameters such as hole cleaning index, CCA and CCI are also calculated.

The outputs 260 include the calculated carbon dioxide by MSE, DSE or average normalized DSE.

Figures 4A, 4B, 4C:
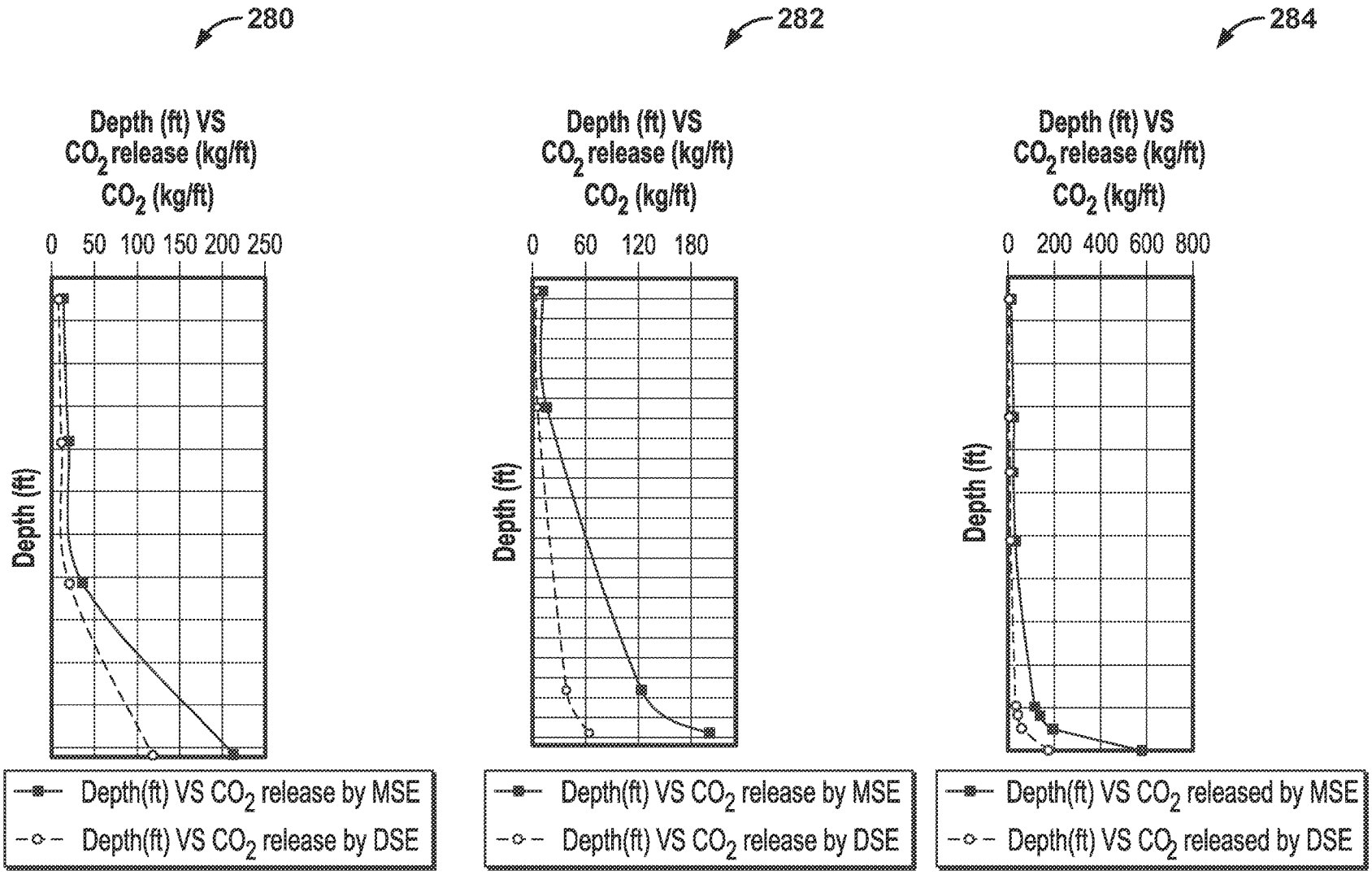
FIGS. 4A-4C show example plots of measured $CO_2$ released versus depth while drilling.

FIGS. 4A-4C show example plots 280, 282, 284 of measured $CO_2$ released versus depth while drilling when the drilling parameters are optimized using MSE and DSE. The data processing system acquired measurements from rig sensors approximately every second. FIG. 4A shows a graph 280 that shows plotted values from Well A, which is a directional well drilled in a formation including sandstone, limestone and shale. The hole diameter of Well A is 12.25 inches. FIG. 4B shows a graph 282 that shows plotted values from Well B, which is a vertical well drilled in a formation including sandstone, limestone, and shale. The hole diameter of Well B was 8.5 inches. FIG. 4C shows a graph 284 that shows plotted values from Well C, which is a directional well drilled in a formation including sandstone, limestone, and shale. The hole diameter of Well C is 8.5 inches.

Figure 5A:
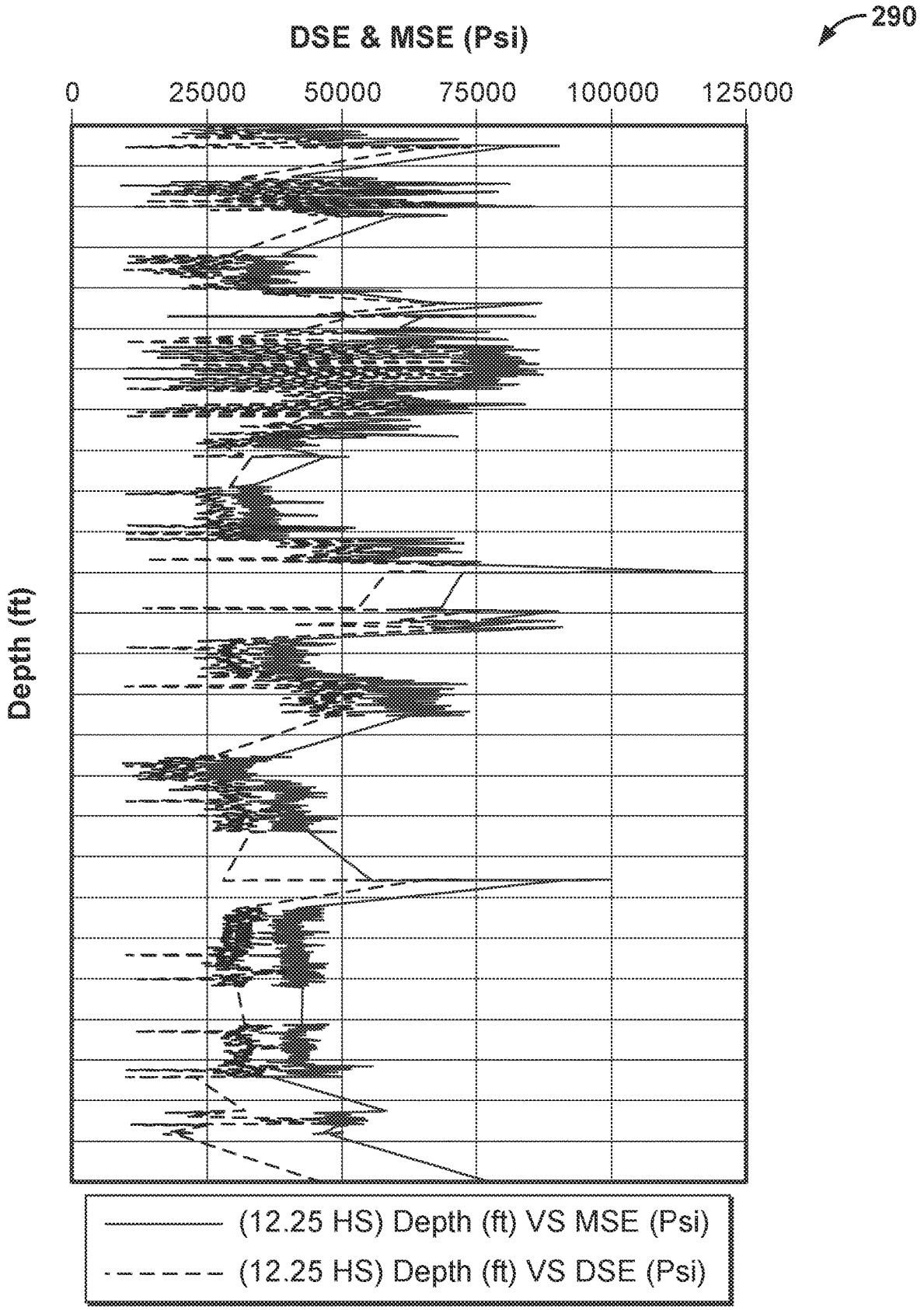
FIGS. 5A-5B show example plots of measured $CO_2$ released versus depth while drilling.
Figure 5B:
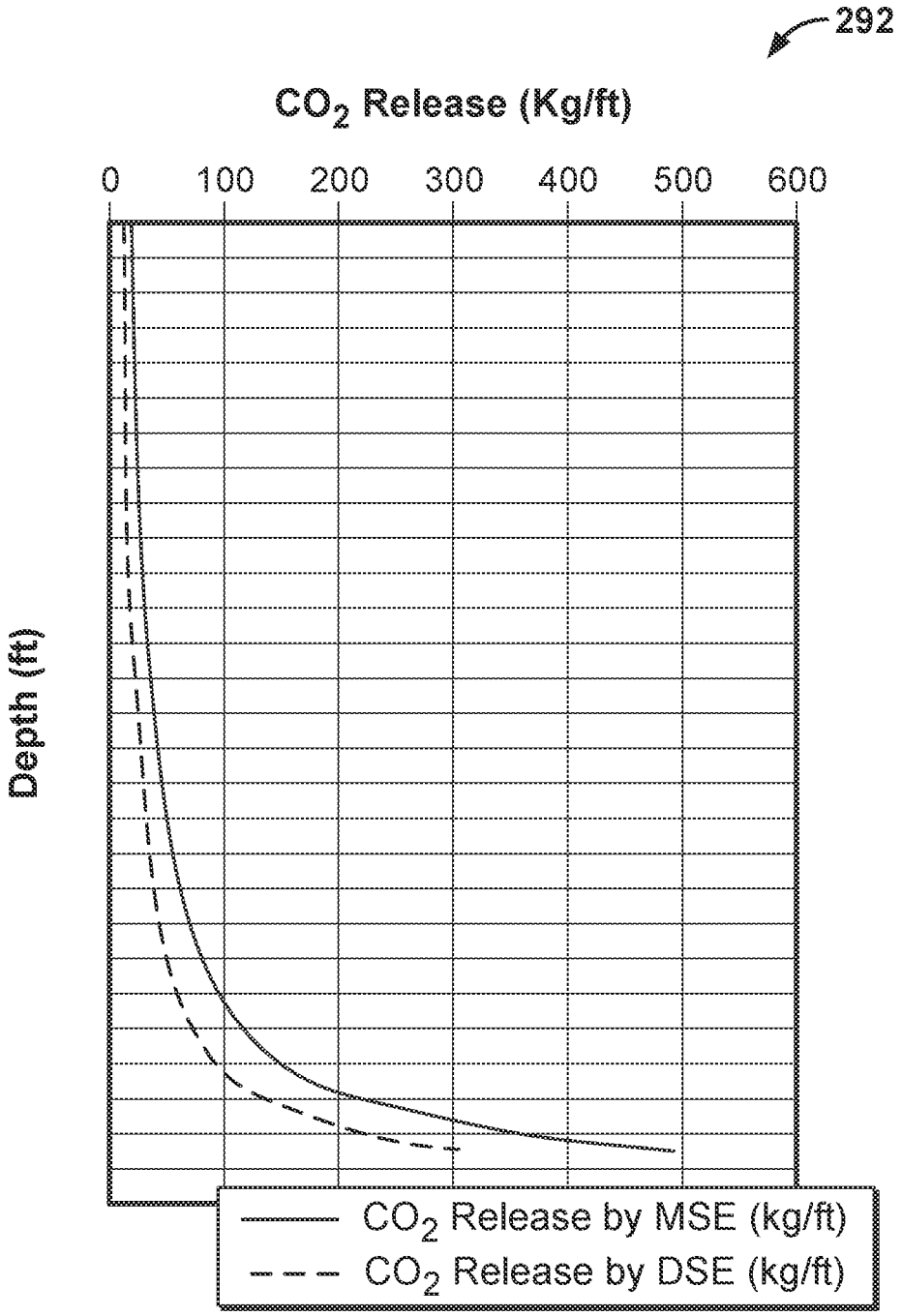

FIGS. 5A-5B show example plots 290, 292 of real-time measurements of MSE, DSE and $CO_2$ produced for Well A. In the example plot 290, the calculated DSE according to equation 20 shows lower values of specific energy as compared with MSE of equation 21. The corresponding $CO_2$ production using the DSE parameters shown in graph 292 is also lower than the $CO_2$ produced when optimizing using MSE.

Figure 6A:
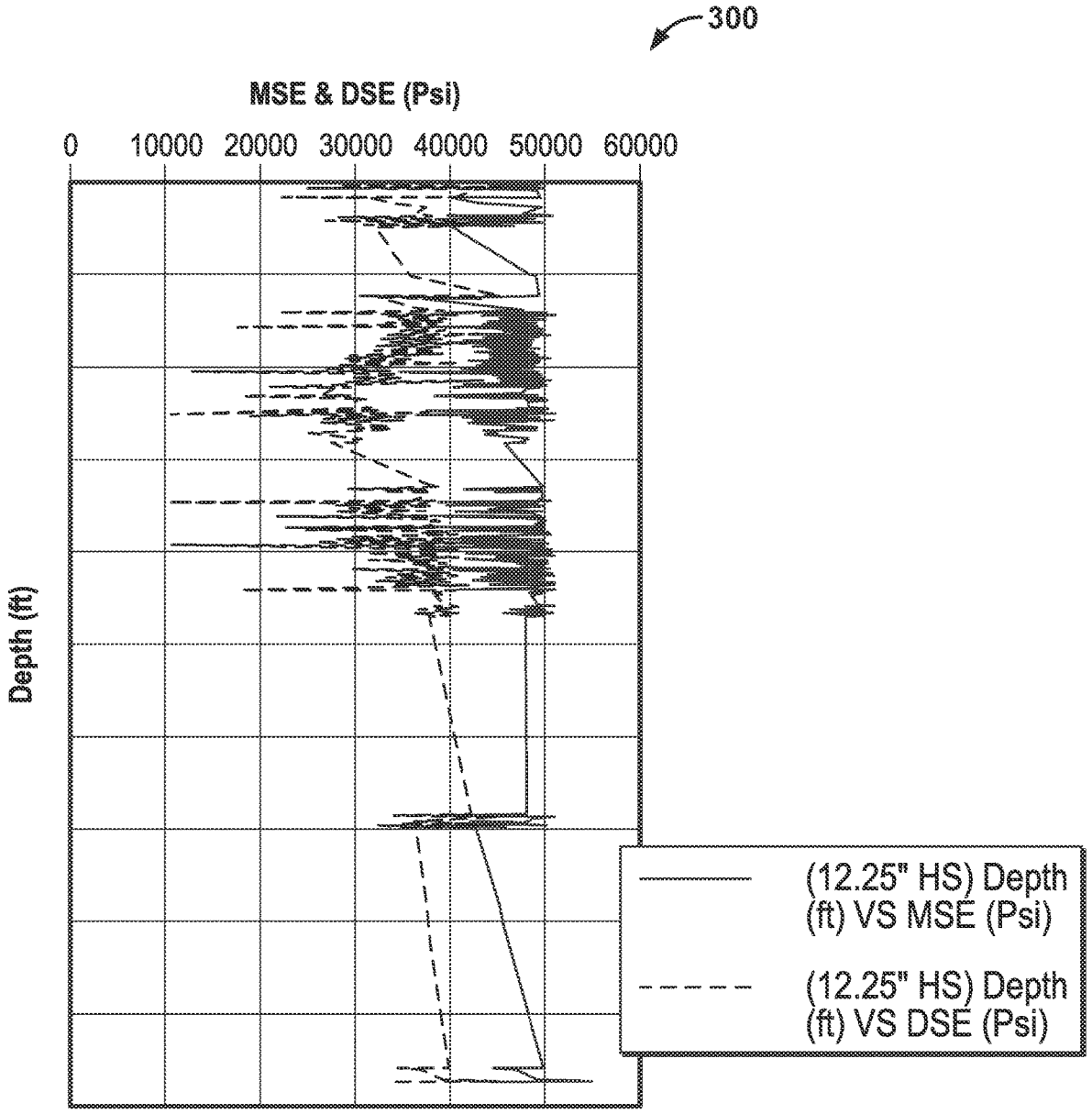
FIGS. 6A-6B show example plots of measured $CO_2$ released versus depth while drilling.
Figure 6B:
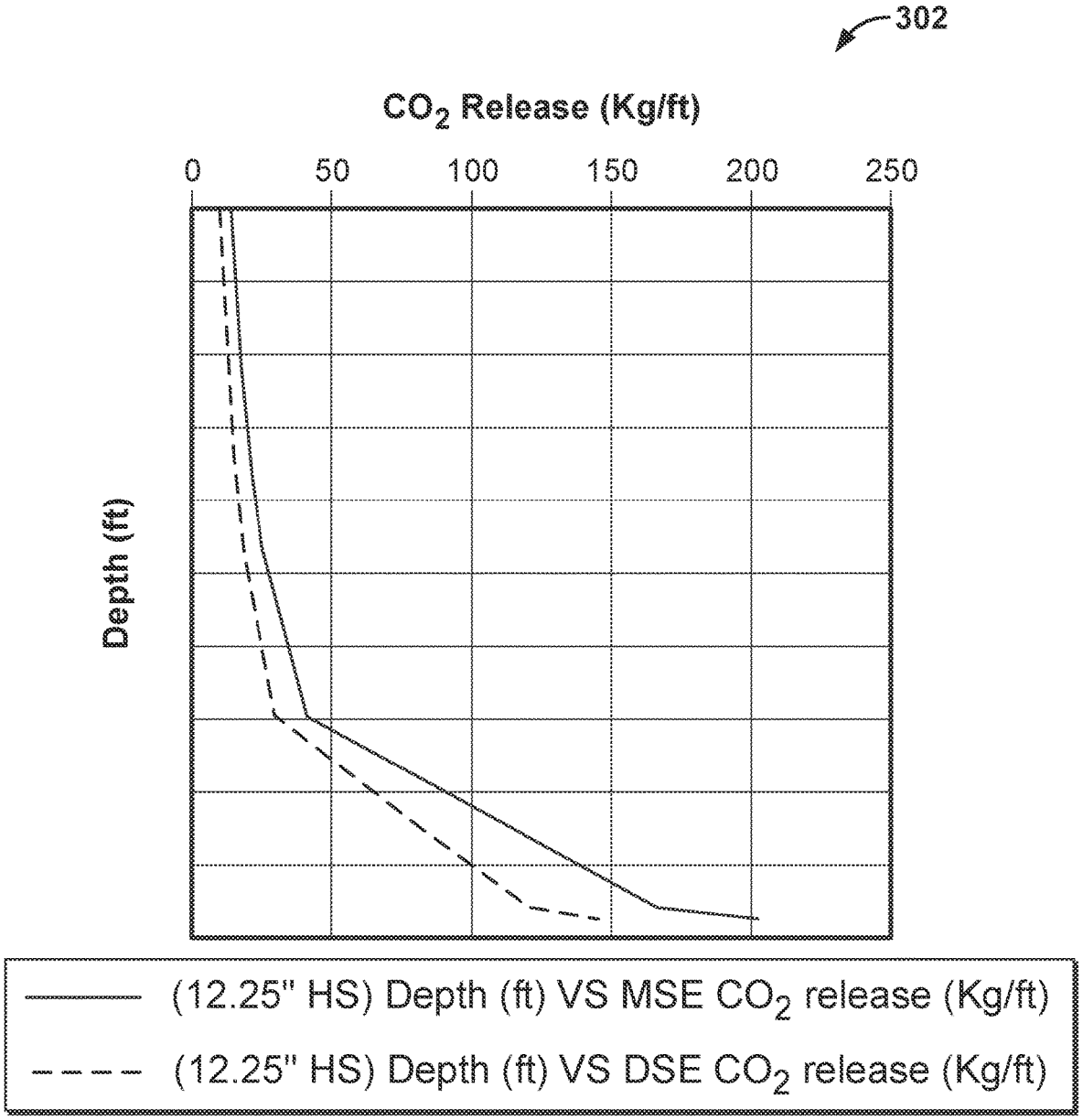

FIGS. 6A-6B show example plots 300, 302 of real-time measurements of MSE, DSE and $CO_2$ produced for Well B. Example plot 300 shows values of the calculated DSE according to equation 20 as compared with an MSE calculated using equation 21. The specific energy based on DSE is lower. Plot 302 shows the corresponding $CO_2$ production using the DSE and MSE values plotted in plot 300. In plot 302 the $CO_2$ production based on optimized DSE is also lower than the $CO_2$ produced when optimizing using MSE.

Table 1 shows minimum, maximum, and average values of $CO_2$ released during drilling of Wells A and B. Across all of the reported statistics, the $CO_2$ released when optimizing based on DSE is less than when optimizing based on MSE. Overall the DSE values are 21% lower than the MSE values on average. Table 2 shows the specific energies calculated according to MSE and DSE while drilling Wells A and B. The average difference across the reported statistics shows DSE 23% lower than the MSE on average.

TABLE 1

$CO_2$ released during drilling of Well A and Well B combined.

| | Minimum $CO_2$ released (kg/ft) | Maximum $CO_2$ released (kg/ft) | Average $CO_2$ released (kg/ft) |
|---|---|---|---|
| MSE | 14 | 202 | 24 |
| DSE | 7 | 183 | 19 |
| Difference % | 50% | 9% | 21% |
| Avg. Difference % | | 27% | |

TABLE 2

Calculated specific energies during drilling for Well A and Well B combined.

| | Minimum (psi) | Maximum (psi) | Average (psi) |
|---|---|---|---|
| MSE | 21699 | 49880 | 44589 |
| DSE | 10091 | 45261 | 34195 |
| Difference % | 53% | 9% | 23% |
| Avg. Difference % | | 29% | |

Figure 7A:
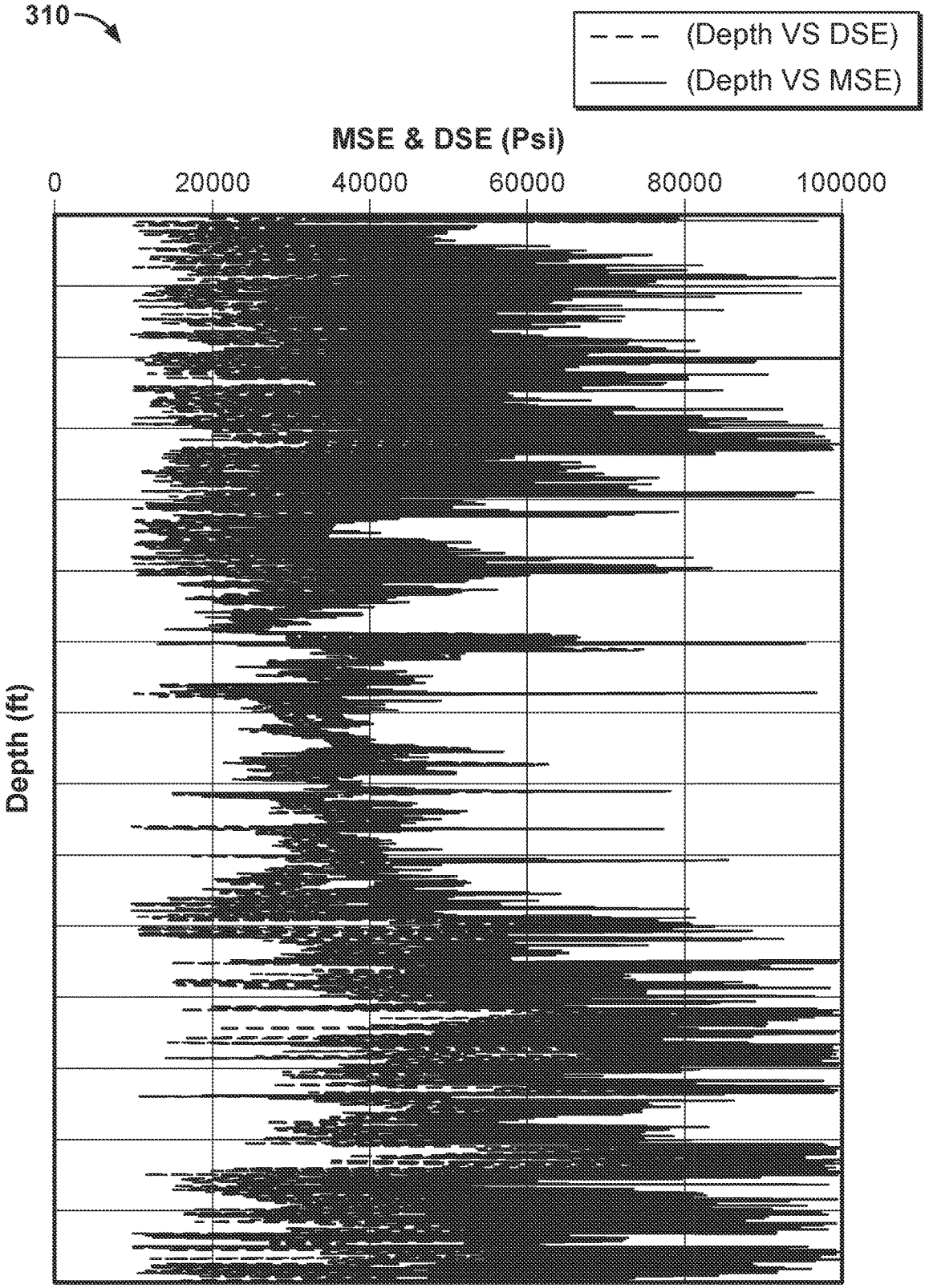
FIGS. 7A-7B show example plots of measured $CO_2$ released versus depth while drilling.
Figure 7B:
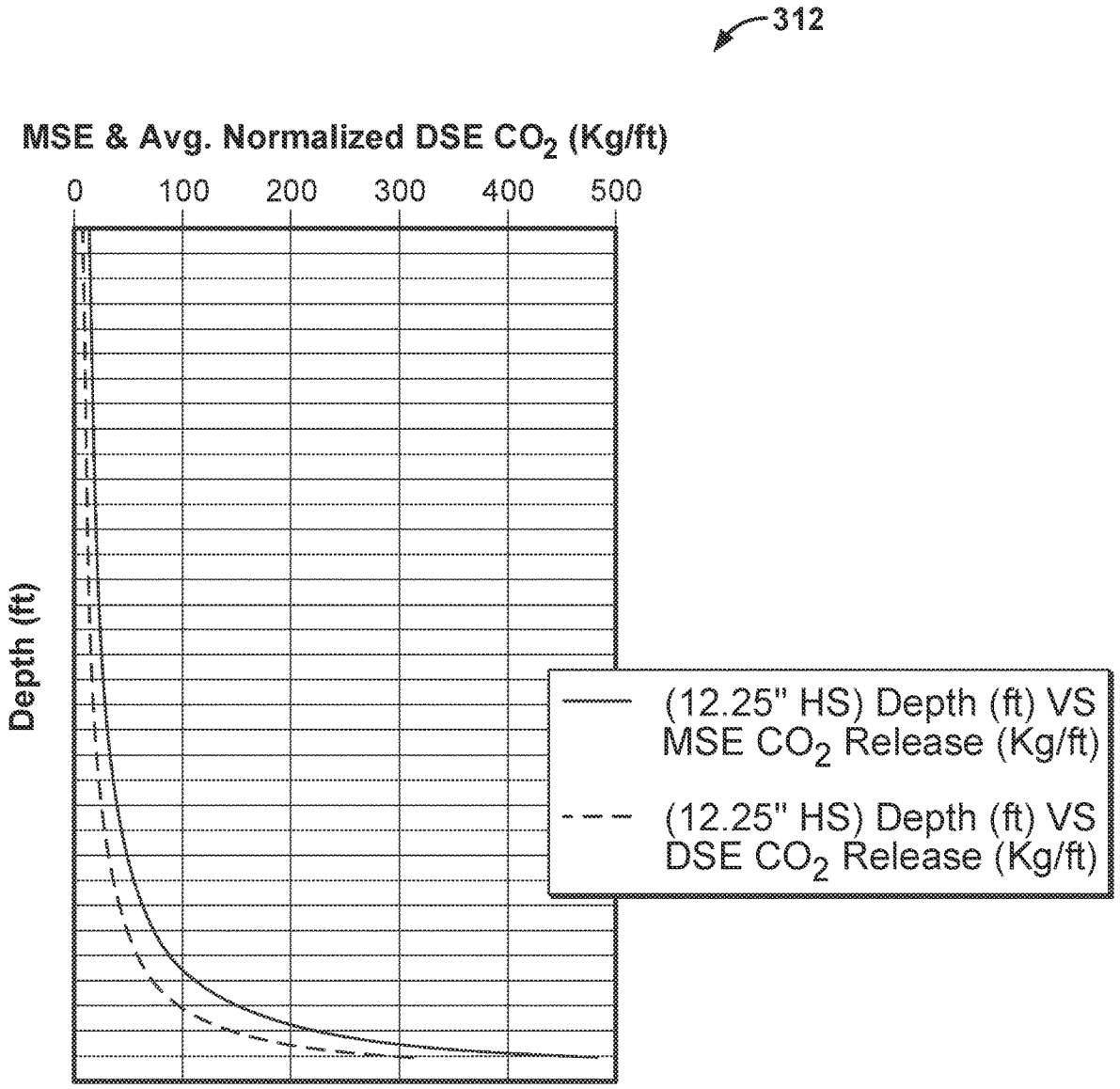

FIGS. 7A-7B show example plots 310, 312 of real-time measurements of MSE, DSE and $CO_2$ produced for Well C. The average normalized DSE according to equation 20 shown in plot 310 shows lower values of specific energy as compared with an MSE calculated using equation 21. Graph 312 shows the values of $CO_2$ production based on optimizing with MSE and DSE. The corresponding $CO_2$ production using the DSE parameters shown in graph 312 is lower than the $CO_2$ produced when optimizing using MSE.

Table 3 shows the minimum, maximum and average released $CO_2$ while drilling Well C. The average difference across all of the statistics reported shows that the $CO_2$ released when determining the drilling parameters using DSE is 36% lower than when using MSE. Table 4 shows the calculated specific energies where the DSE is on average 23% lower than the MSE.

TABLE 3

$CO_2$ released during drilling of Well C.

| | Minimum $CO_2$ released (kg/ft) | Maximum $CO_2$ released (kg/ft) | Average $CO_2$ released (kg/ft) |
|---|---|---|---|
| MSE | 13 | 481 | 49 |
| DSE | 4 | 393 | 39 |
| Difference % | 69% | 18% | 20% |
| Avg. Difference % | | 36% | |

TABLE 4

Calculated specific energies during drilling of Well C.

| | Minimum (psi) | Maximum (psi) | Average (psi) |
|---|---|---|---|
| MSE | 7577 | 754467 | 70699 |
| DSE | 2547 | 540005 | 54689 |
| Difference % | 66% | 28% | 23% |
| Avg. Difference % | | 39% | |

Figure 8A:
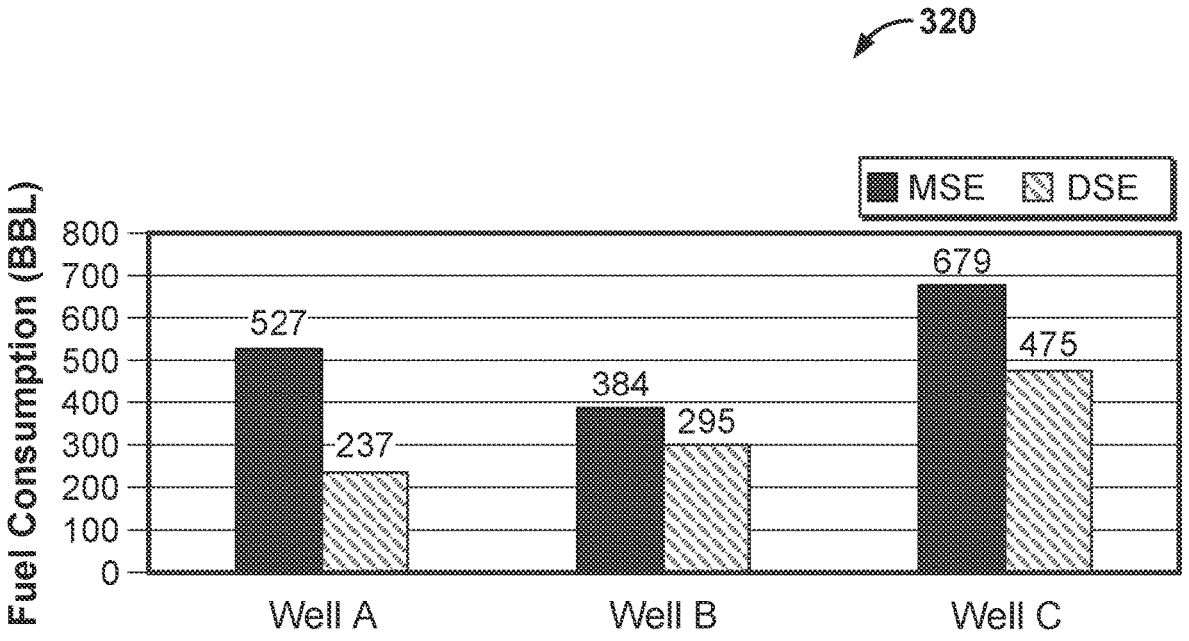
FIGS. 8A-8B show example bar graphs of total fuel consumption and average carbon dioxide released while drilling.

FIG. 8A shows an example bar graph 320 of the total fuel consumption during drilling operations by using DSE versus using MSE to optimize the drilling parameters. For Well A, the DSE optimized drilling used 290 bbl less fuel. For Well B, the DSE optimized drilling used 89 bbl less fuel than the MSE optimized drilling. For Well C, the DSE optimized drilling consumed 204 bbl less fuel than the MSE optimized drilling.

Figure 8B:
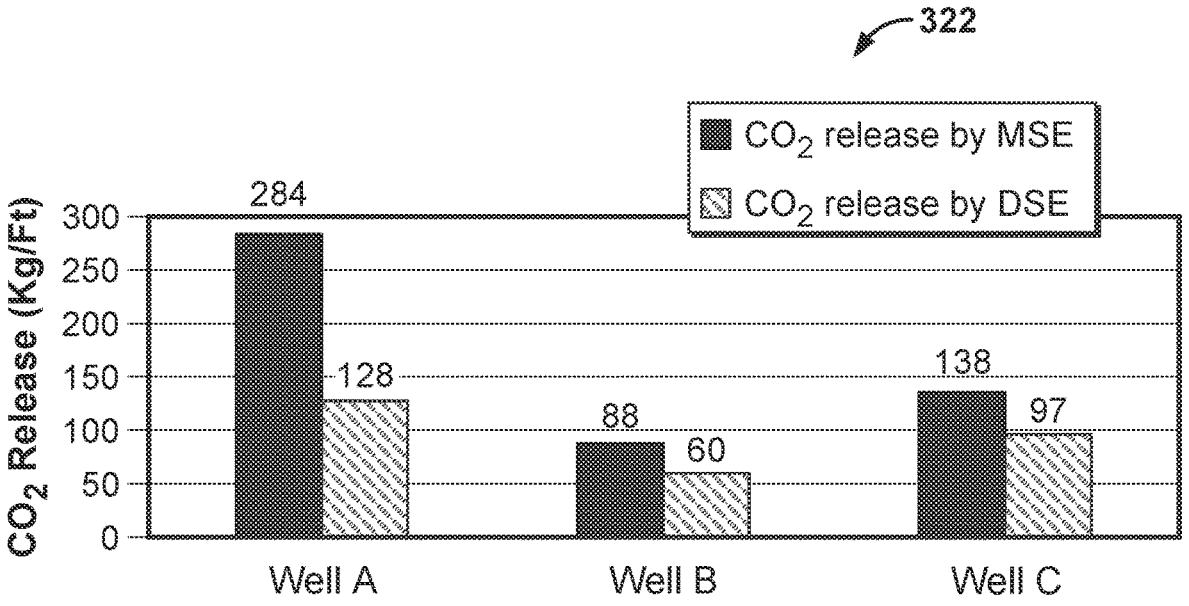

FIG. 8B shows an example bar graph 322 of the average $CO_2$ released during drilling for drilling operations using DSE and MSE optimizations. For Well A, the DSE optimized drilling released 126 kg/ft of $CO_2$ less than the MSE optimized drilling. For Well B, the DSE optimized drilling released 28 kg/ft of $CO_2$ less than the MSE optimized drilling. For Well C, the DSE optimized drilling released 41 kg/ft of $CO_2$ less than the MSE optimized drilling.

Figure 9:
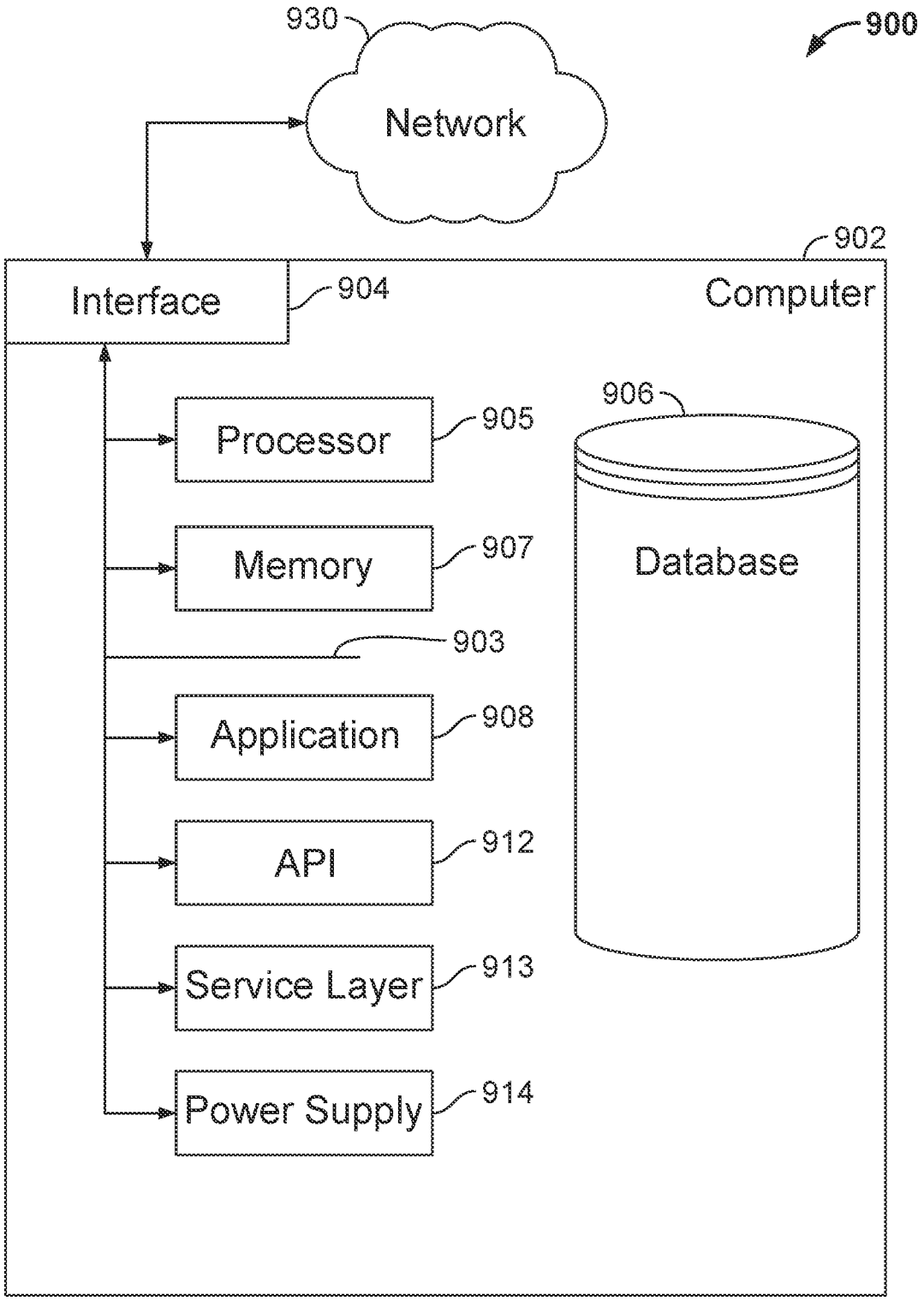
FIG. 9 is a block diagram illustrating an example computer system used to provide computational functionalities associated with described algorithms, methods, functions, processes, flows, and procedures according to some implementations of the present disclosure.

FIG. 9 is a block diagram of an example computer system 900 used to provide computational functionalities associated with described algorithms, methods, functions, processes, flows, and procedures described in the present disclosure, according to some implementations of the present disclosure. The illustrated computer 902 is intended to encompass any computing device such as a server, a desktop computer, a laptop/notebook computer, a wireless data port, a smart phone, a personal data assistant (PDA), a tablet computing device, or one or more processors within these devices, including physical instances, virtual instances, or both. The computer 902 can include input devices such as keypads, keyboards, and touch screens that can accept user information. Also, the computer 902 can include output devices that can convey information associated with the operation of the computer 902. The information can include digital data, visual data, audio information, or a combination of information. The information can be presented in a graphical user interface (UI) (or GUI).

The computer 902 can serve in a role as a client, a network component, a server, a database, a persistency, or components of a computer system for performing the subject matter described in the present disclosure. The illustrated computer 902 is communicably coupled with a network 930. In some implementations, one or more components of the computer 902 can be configured to operate within different environments, including cloud-computing-based environments, local environments, global environments, and combinations of environments.

At a high level, the computer 902 is an electronic computing device operable to receive, transmit, process, store, and manage data and information associated with the described subject matter. According to some implementations, the computer 902 can also include, or be communicably coupled with, an application server, an email server, a web server, a caching server, a streaming data server, or a combination of servers.

The computer 902 can receive requests over network 930 from a client application (for example, executing on another computer 902). The computer 902 can respond to the received requests by processing the received requests using software applications. Requests can also be sent to the computer 902 from internal users (for example, from a command console), external (or third) parties, automated applications, entities, individuals, systems, and computers.

Each of the components of the computer 902 can communicate using a system bus 903. In some implementations, any or all of the components of the computer 902, including hardware or software components, can interface with each other or the interface 904 (or a combination of both), over the system bus 903. Interfaces can use an application programming interface (API) 912, a service layer 913, or a combination of the API 912 and service layer 913. The API 912 can include specifications for routines, data structures, and object classes. The API 912 can be either computer-language independent or dependent. The API 912 can refer to a complete interface, a single function, or a set of APIs.

The service layer 913 can provide software services to the computer 902 and other components (whether illustrated or not) that are communicably coupled to the computer 902. The functionality of the computer 902 can be accessible for all service consumers using this service layer. Software services, such as those provided by the service layer 913, can provide reusable, defined functionalities through a defined interface. For example, the interface can be software written in JAVA, C++, or a language providing data in extensible markup language (XML) format. While illustrated as an integrated component of the computer 902, in alternative implementations, the API 912 or the service layer 913 can be stand-alone components in relation to other components of the computer 902 and other components communicably coupled to the computer 902. Moreover, any or all parts of the API 912 or the service layer 913 can be implemented as child or sub-modules of another software module, enterprise application, or hardware module without departing from the scope of the present disclosure.

The computer 902 includes an interface 904. Although illustrated as a single interface 904 in FIG. 9, two or more interfaces 904 can be used according to particular needs, desires, or particular implementations of the computer 902 and the described functionality. The interface 904 can be used by the computer 902 for communicating with other systems that are connected to the network 930 (whether illustrated or not) in a distributed environment. Generally, the interface 904 can include, or be implemented using, logic encoded in software or hardware (or a combination of software and hardware) operable to communicate with the network 930. More specifically, the interface 904 can include software supporting one or more communication protocols associated with communications. As such, the network 930 or the interface's hardware can be operable to communicate physical signals within and outside of the illustrated computer 902.

The computer 902 includes a processor 905. Although illustrated as a single processor 905 in FIG. 9, two or more processors 905 can be used according to particular needs, desires, or particular implementations of the computer 902 and the described functionality. Generally, the processor 905 can execute instructions and can manipulate data to perform the operations of the computer 902, including operations using algorithms, methods, functions, processes, flows, and procedures as described in the present disclosure.

The computer 902 also includes a database 906 that can hold data for the computer 902 and other components connected to the network 930 (whether illustrated or not). For example, database 906 can be an in-memory, conventional, or a database storing data consistent with the present disclosure. In some implementations, database 906 can be a combination of two or more different database types (for example, hybrid in-memory and conventional databases) according to particular needs, desires, or particular implementations of the computer 902 and the described functionality. Although illustrated as a single database 906 in FIG. 9, two or more databases (of the same, different, or combination of types) can be used according to particular needs, desires, or particular implementations of the computer 902 and the described functionality. While database 906 is illustrated as an internal component of the computer 902, in alternative implementations, database 906 can be external to the computer 902.

The computer 902 also includes a memory 907 that can hold data for the computer 902 or a combination of components connected to the network 930 (whether illustrated or not). Memory 907 can store any data consistent with the present disclosure. In some implementations, memory 907 can be a combination of two or more different types of memory (for example, a combination of semiconductor and magnetic storage) according to particular needs, desires, or particular implementations of the computer 902 and the described functionality. Although illustrated as a single memory 907 in FIG. 9, two or more memories 907 (of the same, different, or combination of types) can be used according to particular needs, desires, or particular implementations of the computer 902 and the described functionality. While memory 907 is illustrated as an internal component of the computer 902, in alternative implementations, memory 907 can be external to the computer 902.

The application 908 can be an algorithmic software engine providing functionality according to particular needs, desires, or particular implementations of the computer 902 and the described functionality. For example, application 908 can serve as one or more components, modules, or applications. Further, although illustrated as a single application 908, the application 908 can be implemented as multiple applications 908 on the computer 902. In addition, although illustrated as internal to the computer 902, in alternative implementations, the application 908 can be external to the computer 902.

The computer 902 can also include a power supply 914. The power supply 914 can include a rechargeable or non-rechargeable battery that can be configured to be either user- or non-user-replaceable. In some implementations, the power supply 914 can include power-conversion and management circuits, including recharging, standby, and power management functionalities. In some implementations, the power-supply 914 can include a power plug to allow the computer 902 to be plugged into a wall socket or a power source to, for example, power the computer 902 or recharge a rechargeable battery.

There can be any number of computers 902 associated with, or external to, a computer system containing computer 902, with each computer 902 communicating over network 930. Further, the terms "client," "user," and other appropriate terminology can be used interchangeably, as appropriate, without departing from the scope of the present disclosure. Moreover, the present disclosure contemplates that many users can use one computer 902 and one user can use multiple computers 902.

Implementations of the subject matter and the functional operations described in this specification can be implemented in digital electronic circuitry, in tangibly embodied computer software or firmware, in computer hardware, including the structures disclosed in this specification and their structural equivalents, or in combinations of one or more of them. Software implementations of the described subject matter can be implemented as one or more computer programs. Each computer program can include one or more modules of computer program instructions encoded on a tangible, non transitory, computer-readable computer-storage medium for execution by, or to control the operation of, data processing apparatus. Alternatively, or additionally, the program instructions can be encoded in/on an artificially generated propagated signal. The example, the signal can be a machine-generated electrical, optical, or electromagnetic signal that is generated to encode information for transmission to suitable receiver apparatus for execution by a data processing apparatus. The computer-storage medium can be a machine-readable storage device, a machine-readable storage substrate, a random or serial access memory device, or a combination of computer-storage mediums.

The terms "data processing apparatus," "computer," and "electronic computer device" (or equivalent as understood by one of ordinary skill in the art) refer to data processing hardware. For example, a data processing apparatus can encompass all kinds of apparatus, devices, and machines for processing data, including by way of example, a programmable processor, a computer, or multiple processors or computers. The apparatus can also include special purpose logic circuitry including, for example, a central processing unit (CPU), a field programmable gate array (FPGA), or an application specific integrated circuit (ASIC). In some implementations, the data processing apparatus or special purpose logic circuitry (or a combination of the data processing apparatus or special purpose logic circuitry) can be hardware- or software-based (or a combination of both hardware- and software-based). The apparatus can optionally include code that creates an execution environment for computer programs, for example, code that constitutes processor firmware, a protocol stack, a database management system, an operating system, or a combination of execution environments. The present disclosure contemplates the use of data processing apparatuses with or without conventional operating systems, for example LINUX, UNIX, WINDOWS, MAC OS, ANDROID, or IOS.

The methods, processes, or logic flows described in this specification can be performed by one or more programmable computers executing one or more computer programs to perform functions by operating on input data and generating output. The methods, processes, or logic flows can also be performed by, and apparatus can also be implemented as, special purpose logic circuitry, for example, a CPU, an FPGA, or an ASIC.

Computer readable media (transitory or non-transitory, as appropriate) suitable for storing computer program instructions and data can include all forms of permanent/non-permanent and volatile/non-volatile memory, media, and memory devices. Computer readable media can include, for example, semiconductor memory devices such as random access memory (RAM), read only memory (ROM), phase change memory (PRAM), static random access memory (SRAM), dynamic random access memory (DRAM), erasable programmable read-only memory (EPROM), electrically erasable programmable read-only memory (EEPROM), and flash memory devices. Computer readable media can also include, for example, magnetic devices such as tape, cartridges, cassettes, and internal/removable disks.

While this specification contains many specific implementation details, these should not be construed as limitations on the scope of what may be claimed, but rather as descriptions of features that may be specific to particular implementations. Certain features that are described in this specification in the context of separate implementations can also be implemented, in combination, in a single implementation. Conversely, various features that are described in the context of a single implementation can also be implemented in multiple implementations, separately, or in any suitable sub-combination. Moreover, although previously described features may be described as acting in certain combinations and even initially claimed as such, one or more features from a claimed combination can, in some cases, be excised from the combination, and the claimed combination may be directed to a sub-combination or variation of a sub-combination.

Particular implementations of the subject matter have been described. Other implementations, alterations, and permutations of the described implementations are within the scope of the following claims as will be apparent to those skilled in the art. While operations are depicted in the drawings or claims in a particular order, this should not be understood as requiring that such operations be performed in the particular order shown or in sequential order, or that all illustrated operations be performed (some operations may be considered optional), to achieve desirable results. In certain circumstances, multitasking or parallel processing (or a combination of multitasking and parallel processing) may be advantageous and performed as deemed appropriate.

Moreover, the separation or integration of various system modules and components in the previously described implementations should not be understood as requiring such separation or integration in all implementations, and it should be understood that the described program components and systems can generally be integrated together in a single software product or packaged into multiple software products.

Accordingly, the previously described example implementations do not define or constrain the present disclosure. Other changes, substitutions, and alterations are also possible without departing from the spirit and scope of the present disclosure.

Furthermore, any claimed implementation is considered to be applicable to at least a computer-implemented method; a non-transitory, computer-readable medium storing computer-readable instructions to perform the computer-implemented method; and a computer system comprising a computer memory interoperably coupled with a hardware processor configured to perform the computer-implemented method or the instructions stored on the non-transitory, computer-readable medium.

A number of embodiments of the invention have been described. Nevertheless, it will be understood that various modifications may be made without departing from the spirit and scope of the invention. For example, the order of steps of the method 200 can be performed in a different order than described herein. Accordingly, other embodiments are within the scope of the following claims.

What is claimed is:

1. A method for evaluating carbon dioxide emissions during drilling operations, the method comprising:

measuring a plurality of mechanical drilling parameters and a plurality of drilling fluid parameters;

determining a hole cleaning index that indicates an effectiveness of removing cuttings from a borehole, the hole cleaning index comprises a cutting concentration in an annulus and a carrying capacity index that specifies the carrying capacity of the drilling fluid, determining being based on the measured parameters;

evaluating hydraulic pressures in the borehole and in a drill bit based on the measured parameters;

calculating a drilling specific energy based on the hole cleaning index and the evaluated hydraulic pressures;

calculating carbon dioxide emissions of the drilling operation based on the drilling specific energy; and determining drilling parameters based on minimizing the drilling specific energy and calculated carbon dioxide emissions.

2. The method of claim 1, further comprising using the determined drilling parameters during drilling operations.

3. The method of claim 1, wherein the determining drilling parameters occurs in real time.

4. The method of claim 1, further comprising, updating the drilling specific energy by evaluating weight on bit, revolutions per minute, standpipe pressure, torque and flow rate.

5. The method of claim 1, further comprising comparing a measured carbon dioxide emissions with the calculated carbon dioxide emissions.

6. The method of claim 1, wherein the carrying capacity index comprises at least one of rheological, chemical, or physical properties of the drilling fluid.

7. The method of claim 1, wherein evaluating the hydraulic pressures comprises evaluating a hydraulic jet impact force of the drill bit.

8. The method of claim 1, wherein a maximum safe rate of penetration is a constraint of the minimization.

9. The method of claim 1, wherein the cuttings concentration in an annulus is less than 0.05.

10. The method of claim 1, further comprising displaying a real-time carbon dioxide release curve.

11. One or more non-transitory machine-readable storage devices storing instructions for evaluating carbon dioxide emissions of drilling operations, the instructions being executable by one or more processing devices to cause performance of operations comprising:

causing measurement of a plurality of mechanical drilling parameters and a plurality of drilling fluid parameters;

determining a hole cleaning index that indicates an effectiveness of removing cuttings from a borehole, the hole cleaning index comprises a cutting concentration in an annulus and a carrying capacity index that specifies the carrying capacity of the drilling fluid, determining being based on the measured parameters;

evaluating hydraulic pressures in the borehole and in a drill bit based on the measured parameters;

calculating a drilling specific energy based on the hole cleaning index and the evaluated hydraulic pressures;

calculating carbon dioxide emissions of the drilling operation based on the drilling specific energy; and determining drilling parameters based on minimizing the drilling specific energy and calculated carbon dioxide emissions.

12. The non-transitory machine-readable storage devices of claim 11, wherein the determining drilling parameters occurs in real time.

13. The non-transitory machine-readable storage devices of claim 11, wherein the operations further comprise updating the drilling specific energy by evaluating weight on bit, revolutions per minute, standpipe pressure, torque and flow rate.

14. The non-transitory machine-readable storage devices of claim 11, wherein the operations further comprise comparing a measured carbon dioxide emissions with the calculated carbon dioxide emissions.

15. The non-transitory machine-readable storage devices of claim 11, wherein the operations further comprise displaying a real-time carbon dioxide release curve.

16. A system for evaluating carbon dioxide emissions during drilling operations, the system comprising:

at least one processor; and a memory storing instructions that, when executed by the at least one processor, cause the at least one processor to perform operations comprising:

measuring a plurality of mechanical drilling parameters and a plurality of drilling fluid parameters;

determining a hole cleaning index that indicates an effectiveness of removing cuttings from a borehole, the hole cleaning index comprises a cutting concentration in an annulus and a carrying capacity index that specifies the carrying capacity of the drilling fluid, determining being based on the measured parameters;

evaluating hydraulic pressures in the borehole and in a drill bit based on the measured parameters;

calculating a drilling specific energy based on the hole cleaning index and the evaluated hydraulic pressures;

calculating carbon dioxide emissions of the drilling operation based on the drilling specific energy; and determining drilling parameters based on minimizing the drilling specific energy and calculated carbon dioxide emissions.

17. The system of claim 16, wherein the determining drilling parameters occurs in real time.

18. The system of claim 16, wherein the operations further comprise updating the drilling specific energy by evaluating weight on bit, revolutions per minute, standpipe pressure, torque and flow rate.

19. The system of claim 16, wherein the operations further comprise comparing a measured carbon dioxide emissions with the calculated carbon dioxide emissions.

20. The system of claim 16, wherein the operations further comprise displaying a real-time carbon dioxide release curve.

* * * * *